US005352849A

United States Patent [19]

Kobayashi

[11] Patent Number: 5,352,849

[45] Date of Patent: Oct. 4, 1994

[54] MUSICAL TONE SYNTHESIZING APPARATUS SIMULATING INTERACTION BETWEEN PLURAL STRINGS

[75] Inventor: Kaoru Kobayashi, Owariasahi, Japan

[73] Assignee: Yamaha Corporation, Hamamatsu, Japan

[21] Appl. No.: 708,480

[22] Filed: May 31, 1991

[30] Foreign Application Priority Data

Jun. 1, 1990 [JP] Japan ..... 2-143735

[51] Int. Cl.[5] ..... G10H 5/02

[52] U.S. Cl. ..... 84/659; 84/630; 84/662; 84/DIG. 10

[58] Field of Search ..... 84/600-603, 84/607, 608, 622, 623, 626, 630, 647, 661, 662, DIG. 9, DIG. 10, 659

[56] References Cited

U.S. PATENT DOCUMENTS

| | | | |
|---|---|---|---|
| 4,130,043 | 12/1978 | Niimi | 84/1.03 |
| 4,649,783 | 3/1987 | Strong et al. | 84/606 |
| 4,736,663 | 4/1988 | Wawrzynek et al. | 84/DIG. 9 X |
| 4,815,354 | 3/1989 | Kunimoto | 84/DIG. 9 X |
| 4,868,869 | 9/1989 | Kramer | 84/622 |
| 4,909,121 | 3/1990 | Usa et al. | 84/606 |
| 4,984,276 | 1/1991 | Smith | 381/63 |
| 5,113,743 | 5/1992 | Higashi | 84/622 |
| 5,117,729 | 6/1992 | Kunimoto | 84/660 |
| 5,131,310 | 7/1992 | Kunimoto | 84/622 X |

FOREIGN PATENT DOCUMENTS

| | | | |
|---|---|---|---|
| 0410476 | 7/1990 | European Pat. Off. | G10H 1/00 |
| 61-163390 | 7/1986 | Japan . | |

OTHER PUBLICATIONS

Nakamura et al. "The Sound Production Mechanism of the Piano Using a Digital Filter by Computer Simulation", 13th International Cong. on Acoustics 1989, pp. 65-67.

Garnett "Modeling Piano Sound Using Waveguide Digital Filtering Techniques", 1987 ICMC Proceedings, pp. 89-95.

Chafe, Chris, "Pulsed Noise in Self-Sustained Oscillations of Musical Instruments," *IEEE,* Apr. 3, 1990 (2): 1157-1160.

*Primary Examiner*—William M. Shoop, Jr.
*Assistant Examiner*—Jeffrey W. Donels
*Attorney, Agent, or Firm*—Graham & James

[57] ABSTRACT

A musical tone synthesizing apparatus is designed to simulate a physical phenomenon of a non-electronic musical instrument providing a sound generating element and an activating element. Herein, the sound generating element has its specific resonance characteristic, while the activating element imparts an excitation vibration to the sound generating element. This apparatus contains a plurality of loop circuits each including at least one delay element, wherein these loop circuits are connected together such that a signal picked up from one loop circuit is introduced into another loop circuit. This signal circulating through each loop circuit is delayed by a delay time which is controlled by a predetermined parameter corresponding to a desirable musical tone to be generated. In addition, an excitation signal, corresponding to the excitation vibration, is applied to at least one of the loop circuits. Preferably, the non-electronic musical instrument is a piano, so that the sound generating element is a string and the activating element is a hammer which strikes the string. Further, number of the loop circuits is set corresponding to the number of strings to be provided with respect to each key of the piano.

18 Claims, 5 Drawing Sheets

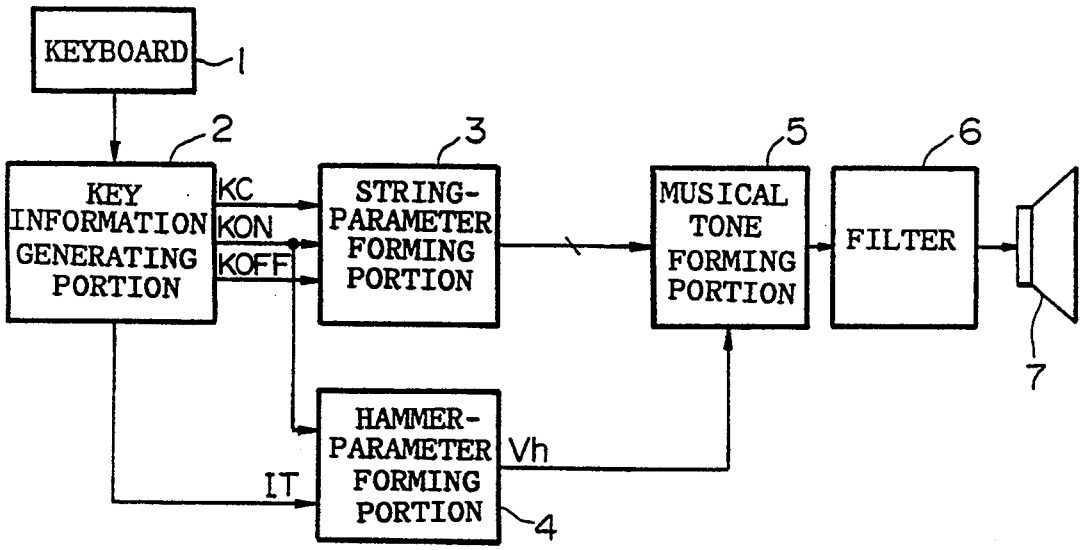
FIG.1
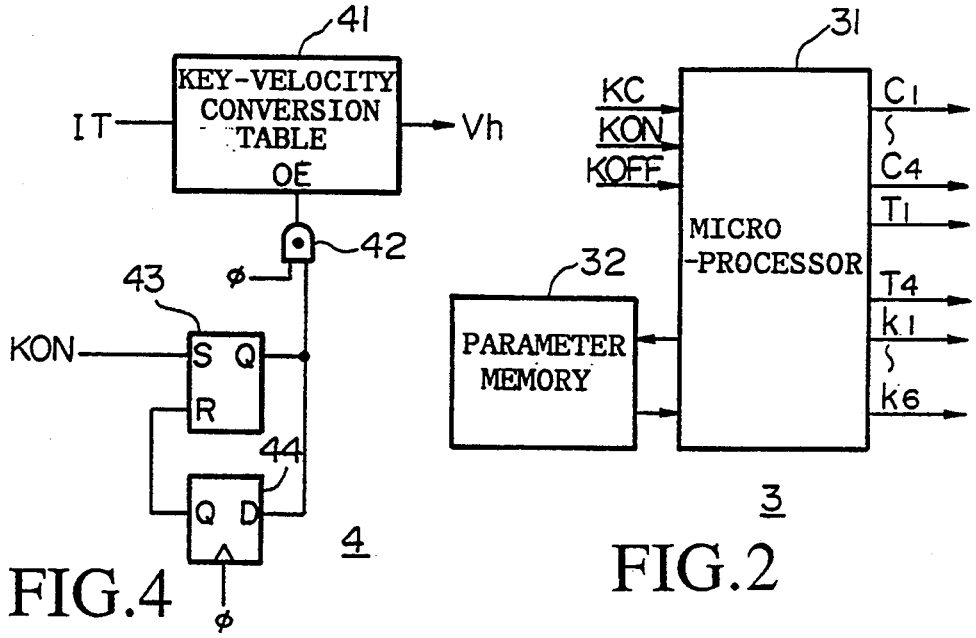
FIG.4
FIG.2
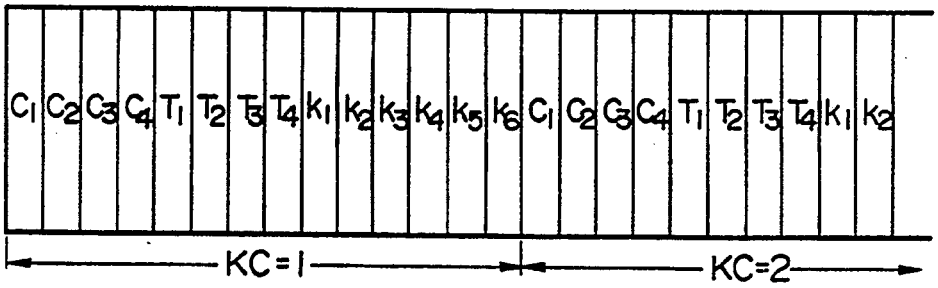
FIG.3

MUSICAL TONE SYNTHESIZING APPARATUS SIMULATING INTERACTION BETWEEN PLURAL STRINGS

BACKGROUND OF THE INVENTION

1. Field of the Invention

The present invention relates to a musical tone synthesizing apparatus which is suitable for synthesizing a musical tone of a string-striking-type instrument such as a piano and a string-plucking-type instrument such as a guitar.

2. Prior Art

Conventionally, there is a known musical tone synthesizing apparatus which activates a simulation model for the musical tone generation of the non-electronic musical instrument to thereby synthesize sounds of the non-electronic musical instrument. The conventionally known musical tone synthesizing apparatus, which is designed to synthesize sounds of the percussion-type instrument or string-plucking-type instrument, has a configuration including a loop circuit and an excitation circuit. Herein, the loop circuit further includes a delay circuit simulating the propagation delay of vibration of the string and a filter simulating the acoustic loss to be occurred by the string. In addition, the excitation circuit supplies an excitation signal to the loop circuit, wherein this excitation signal corresponds to an excitation vibration to be occurred when plucking or striking the string. The above-mentioned apparatus is disclosed in Japanese Patent Laid-Open Publication No. 63-40199 and Japanese Patent Publication No. 58-58679, for example.

In general, the piano provides plural strings with respect to each key. Strictly speaking, each string has a different tension characteristic, so that each string may produce a slightly different pitch. As a result, unique sounds can be sounded from each piano. More specifically, a vibration energy applied to each string propagates toward another string via a fret portion. Therefore, "mutual interference" is made between the strings via the fret portion, so that the piano can produce a sound having a delicate fluctuation. Herein, the mutual interference does not designate a mere interference of wave but it designates an interference of vibration energy, so that it can be defined as "mutual interference with energy exchange". Such phenomenon can be found in the performance of the guitar and violin other than the piano. More specifically, when playing the guitar or violin, the string, provided next to the actually plucked string, resonates to the vibration of the actually plucked string, which allows generation of the musical sound having the pleasant sound quality. However, the conventional apparatus cannot accurately reproduce sounds having characteristics affected by the pitch difference or the foregoing mutual interference among strings.

SUMMARY OF THE INVENTION

It is accordingly a primary object of the present invention to provide a musical tone synthesizing apparatus capable of reproducing the sounds of which characteristics are affected by the pitch difference and mutual interference between the strings.

In a first aspect of the present invention, in a musical tone synthesizing apparatus which synthesizes a musical tone by simulating a physical phenomenon of a non-electronic musical instrument providing a sound generating element having its specific resonance characteristic and an activating element for imparting an excitation vibration to the sound generating element, there is provided a musical tone synthesizing apparatus comprising:

parameter generating means for generating a parameter corresponding to a desirable musical tone to be generated;

a plurality of loop means each including at least one delay element;

connection means for connecting a plurality of loop means together such that a signal picked up from one of a plurality of loop means is introduced into another of a plurality of loop means, wherein a delay time by which a signal circulates through one loop means once is controlled by the parameter; and input means for inputting an excitation signal into at least one of a plurality of loop means, wherein the excitation signal is set corresponding to the excitation vibration, whereby a synthesized musical tone signal is to be picked up from the connection means.

In a second aspect of the present invention, there is provided a musical tone synthesizing apparatus comprising:

a first loop means, including at least one delay element, for delaying an input signal while the input signal circulates therethrough so that a first resonance effect is imparted to the input signal so as to synthesize a first musical tone signal;

a second loop means, including at least one delay element, for delaying the input signal while the input signal circulates therethrough so that a second resonance effect is imparted to the input signal so as to synthesize a second musical tone signal;

introducing means for introducing the first musical tone signal into the second loop means; and an adding means for adding outputs of the first and second loop means together, whereby an interference with energy exchange occurs so that a delicate musical tone is synthesized.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 1 is a block diagram showing configuration of a musical tone synthesizing apparatus according to a first embodiment of the present invention;

FIG. 2 is a block diagram showing detailed configuration of a string-parameter forming portion shown in FIG. 1;

FIG. 3 is a diagram showing storing contents of a parameter memory shown in FIG. 2;

FIG. 4 is a block diagram showing detailed configuration of a hammer-parameter forming portion shown in FIG. 1;

DESCRIPTION OF THE PREFERRED EMBODIMENTS

Figure 5:
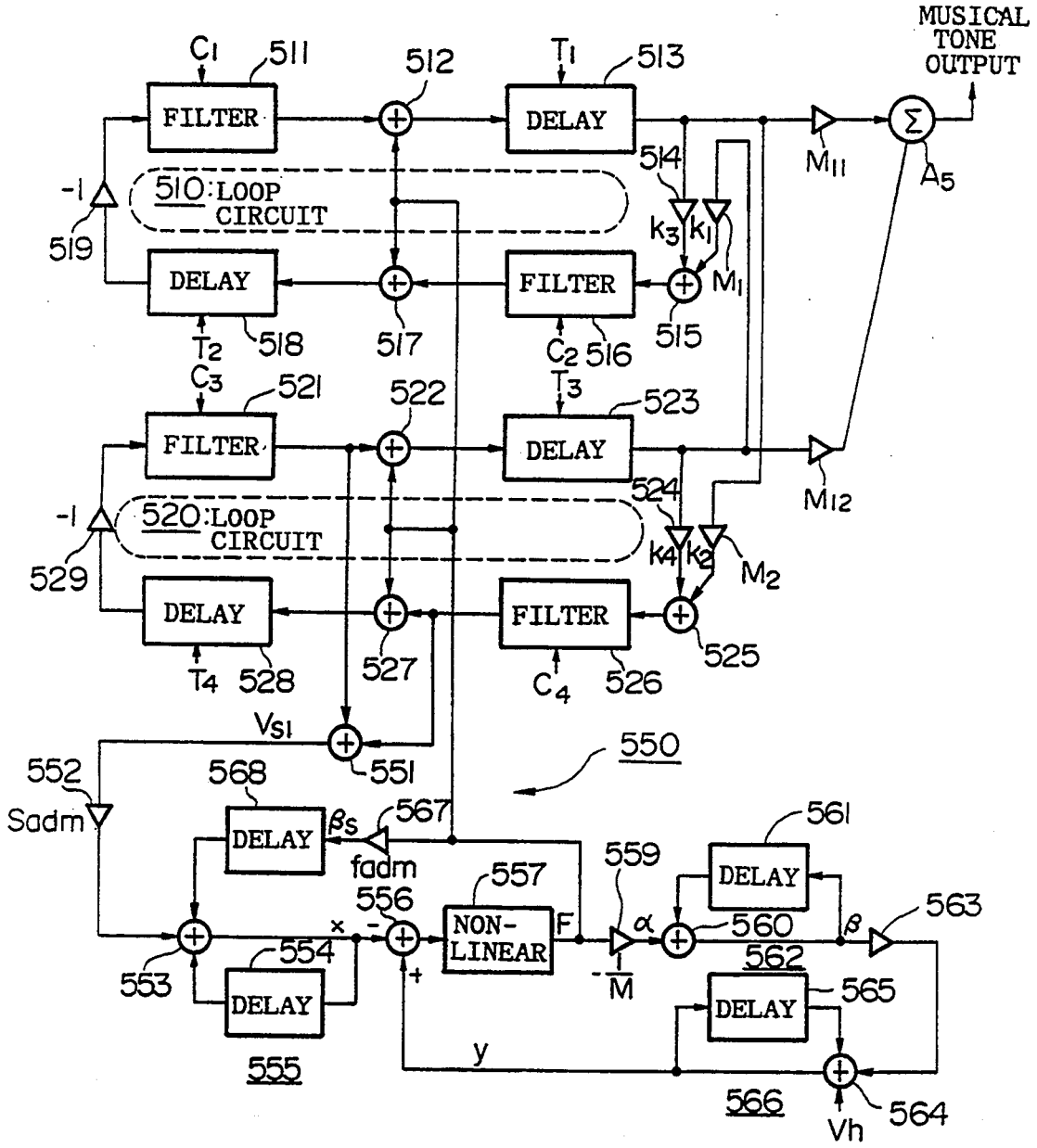
FIG. 5 is a block diagram showing detailed configuration of a musical tone forming portion shown in FIG. 1.

Now, description will be given with respect to the preferred embodiments of the present invention by referring to the drawings, wherein like reference characters designate like or corresponding parts throughout the several views.

A FIRST EMBODIMENT

(1) Configuration

FIG. 1 is a block diagram showing configuration of the musical tone synthesizing apparatus according to the first embodiment of the present invention. In FIG. 1, 1 designates a keyboard provided for the electronic musical instrument, and 2 designates a key information generating portion. Herein, when a key depression is made in the keyboard 1, the key information generating portion 2 outputs keycode information KC representing the depressed key, a key-on signal KON representing the key-on event and initial-touch information IT representing the key-depression intensity. On the other hand, when the depressed key is released, the key information generating portion 2 outputs a key-off signal KOFF.

In addition, 3 designates a string-parameter forming portion which is configured as shown in FIG. 2 by a microprocessor 31 and a parameter memory 32, wherein this parameter memory 32 is embodied by a read-only memory (ROM). Upon receipt of the keycode information KC and key-on signal KON or key-off signal KOFF, the microprocessor 31 computes delay information T1–T4, filter coefficients C1–C4 and multiplication coefficients k1–k6 on the basis of the keycode information KC. Each of the above-mentioned parameters is stored in the parameter memory 32 as shown in FIG. 3. Upon receipt of the key-on signal KON, the microprocessor 31 reads desirable information corresponding to the keycode information KC from the parameter memory 32. Incidentally, detailed description will be given later with respect to each parameter T1–T4, C1–C4, k1–k6.

In FIG. 1, 4 designates a hammer-parameter forming portion, which is configured as shown in FIG. 4. In FIG. 4, a R-S flip-flop (i.e., reset-set-type flip-flop) 43 is set by the key-on signal KON, so that an output Q thereof is inputted into a D-type flip-flop (i.e., delayed-type flip-flop) 44 in synchronism with a clock $\phi$ to be produced by every predetermined period. Then, the R-S flip-flop 43 is reset by an output Q of the D-type flip-flop 44. In addition, an AND gate 42 inputs the clock $\phi$ and output Q of the flip-flop 43, so that the output thereof is supplied to a ROM 41 (i.e., key-velocity conversion table) as an output enable signal OE. This ROM 41 pre-stores information representing the hammer velocity corresponding to the initial-touch information IT.

In the hammer-parameter forming portion 4, after receiving the key-on signal KON, the ROM 41 is set in the enable state during the period corresponding to one cycle of the clock $\phi$, so that the hammer-parameter forming portion 4 outputs a hammer velocity signal Vh corresponding to the initial-touch information IT.

Meanwhile, 5 designates a musical tone forming portion, which is configured as shown in FIG. 5. This musical tone forming portion 5 is designed to form a piano sound providing two strings with respect to each key. In FIG. 5, the musical tone forming portion 5 contains two loop circuits 510, 520 each having the similar configuration, wherein the loop circuit 510 consists of a filter 511, an adder 512, a delay circuit 513, a multiplier 514, an adder 515, a filter 516, an adder 517, a delay circuit 518 and a phase inverter 519. Each of these loop circuits 510, 520 is designed to simulate the reciprocating propagation of the vibration on each of two strings.

The delay circuits 513, 518 are configured as the variable delay circuit of which delay time can be varied, so that they are designed to simulate the propagation delay of the vibration with respect to a first string within two strings. Herein, their delay times are controlled in response to the delay information T1, T2 to be generated from the foregoing string-parameter forming portion 3. Similarly, other delay circuits 523, 528 corresponding to a second string are supplied with other delay information T3, T4. Such variable delay time can be embodied by a shift register and a selector, for example. Herein, the shift register delays an input signal, and the selector selectively outputs a delayed output at each stage of the shift register in accordance with the delay information.

In case of the actual acoustic piano, the same tension cannot be always imparted to each of the strings corresponding to each key, which occurs the so-called de-tune effect. Thus, under consideration of such de-tune effect to be normally occurred in the piano, the delay information T1–T4 is set such that the total delay times of the loop circuits 510, 520 will roughly correspond to the same pitch but they are slightly different from each other.

Each pair of the filters 511, 516 and 521, 526 is designed to simulate the acoustic loss to be occurred with respect to each string. Normally, as the pitch becomes higher, the acoustic loss becomes larger. Thus, these filters are embodied as the low-pass filter. Herein, the filter coefficients C1, C2, C3, C4 generated from the string-parameter forming portion 3 are supplied to the filters 511, 516, 521, 526 respectively. Based on these coefficients, each filter performs the filtering operation corresponding to the keycode information KC.

Each pair of the phase inverter 519, multiplier 514 and phase inverter 529, multiplier 524 is provided to simulate the phase inversion phenomenon which is occurred when the vibration is reflected at both edges of each string. During generation of the musical tone, the multipliers 514, 524 are supplied with negative multiplication coefficients k3, k4 from the string-parameter forming portion 3. Then, when the key-off signal KOFF is generated in accordance with the key release event, the multiplication coefficients k3, k4 are switched over by the string-parameter forming portion 3 so that their absolute values are reduced. Thus, the musical tone will be rapidly attenuated.

The output of the delay circuit 513 in the loop circuit 510 is supplied to a multiplier M2 wherein it is multiplied by the multiplication coefficient k2. Then, multiplication result of the multiplier M2 is introduced into the loop circuit 520 via an adder 525. Similarly, the output of the delay circuit 523 in the loop circuit 520 is supplied to a multiplier M1 having the multiplication coefficient k1. Then, multiplication result of the multiplier M1 is introduced into the loop circuit 510 via an adder 515. Due to such configuration, signal transfer is made between the loop circuits 510, 520, which simulates the mutual interference between the strings. Incidentally, each of the multiplication coefficients k1, k2 is set further smaller than "1". In short, these coefficients are set in response to the degree of the mutual interference to be embodied.

Next, description will be given with respect to an excitation circuit 550 which is designed to produce an excitation signal corresponding to the excitation vibration to be imparted to the string by the hammer. The outputs of the filters 521, 526 in the loop circuit 520 are supplied to an adder 551 wherein they are added together. Then, the adder 551 outputs a string velocity signal Vs1 corresponding to the vibrating velocity of the string. This string velocity signal Vs1 is multiplied by a coefficient sadm in a multiplier 552. Incidentally, detailed description of this coefficient sadm will be given later.

Figure 6:
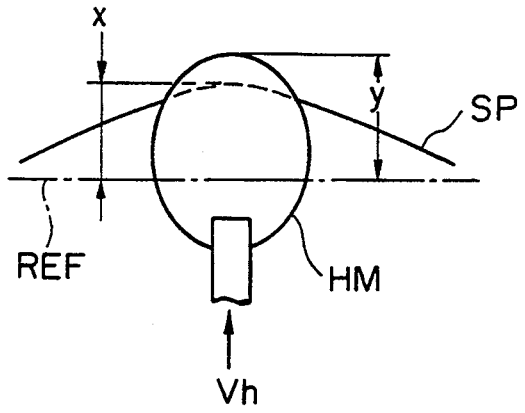
FIG. 6 is a drawing illustrating a simulation model wherein a hammer strikes a string in the piano.

Then, multiplication result of the multiplier 552, i.e., "sadm*Vs1", is subject to the integration in an integration circuit 555 consisting of an adder 553 and a one-sample-period delay circuit 554. Thus, the integration circuit 555 outputs a string displacement signal "x" representing displacement of a piano string SP from a reference line REF as illustrated in FIG. 6. Such string displacement signal x is supplied to a first input terminal of a subtractor 556. Herein, a second input terminal of the subtractor 556 is supplied with a hammer displacement signal "y", representing displacement of a hammer HM (see FIG. 6), from an integration circuit 566 which will be described later in detail. Thus, the subtractor 556 outputs a relative displacement signal "y−x" representing relative displacement between the hammer HM and string SP.

In the case where the string SP partially cuts into the hammer HM, the relative displacement signal y−x has a positive value, so that the repulsion force corresponding to the cutting amount is imparted to the string SP and hammer HM. On the other hand, in the case where the hammer HM slightly touches the string SP or the hammer HM is positioned apart from the string SP, the relative displacement signal y−x has a negative value, representing that the repulsion force is at zero level.

Figure 7:
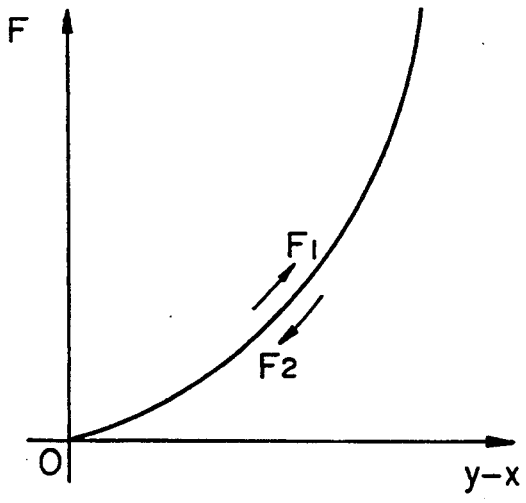
FIG. 7 is a graph showing relationship between a relative displacement signal "y−x" and a repulsion force signal "F" shown in FIG. 5.

The above-mentioned relative displacement signal y−x outputted from the subtractor 556 is supplied to a non-linear circuit 557. Based on the relative displacement signal y−x, the non-linear circuit 557 computes a repulsion force signal F corresponding to the repulsion force to be occurred between the string SP and hammer HM. This non-linear circuit 557 is embodied by a ROM which stores a table representing a non-linear function having the quadratic curve characteristic as shown in FIG. 7, for example.

The above-mentioned repulsion force signal F is supplied to the adders 512, 517 in the loop circuit 510 and it is also supplied to the adders 522, 527 in the loop circuit 520. According to the general circuit configuration, the repulsion force signal F is multiplied by the coefficient corresponding to the resistance representing the velocity variation of the string SP, and a half value of the computed velocity variation component is supplied to the loop circuits 510, 520. However, the present embodiment is designed different from such general circuit configuration. In the present embodiment, it is possible to incorporate the above-mentioned resistance representing the velocity variation of the string SP in the computation by adjusting the multiplication coefficient sadm.

Meanwhile, the repulsion force signal F is multiplied by a coefficient fadm in a multiplier 567 so as to compute a string velocity signal $\beta s$ corresponding to the velocity variation component which is applied to the string SP by the hammer HM. This string velocity signal $\beta s$ is delayed by one sample period by a delay circuit 568, so that the delayed output is supplied to the integration circuit 555. Thus, it is possible to simulate the phenomenon in which the string SP is subject to the displacement to be occurred when the hammer HM strikes the string SP.

The repulsion force signal F is also supplied to a multiplier 559 to which a multiplication coefficient "−1/M" (where M denotes inertia mass of the hammer HM) is given. As a result, the multiplier 559 outputs a hammer acceleration signal $\alpha$ corresponding to the acceleration of the hammer HM. This hammer acceleration signal $\alpha$ is integrated by an integration circuit 562 consisting of an adder 560 and a delay circuit 561. Thus, the integration circuit 562 outputs a hammer velocity signal $\beta$ corresponding to the velocity variation component of the hammer HM. This hammer velocity signal $\beta$ is supplied to a multiplier 563 wherein it is multiplied by the predetermined attenuation coefficient. Then, both of the output of multiplier 563 and the hammer velocity signal Vh (representing the initial velocity of the hammer) which is generated from the foregoing hammer-parameter forming portion 4 are supplied to the integration circuit 566 consisting of an adder 564 and a delay circuit 565, so that this integration circuit 566 outputs the foregoing hammer displacement signal y.

The outputs of the delay circuits 513, 523 in the loop circuits 510, 520 are respectively supplied to multipliers M11, M12 wherein they are multiplied by respective multiplication coefficients. The multiplication results of the multipliers M11, M12 are added together in an adder A5, which addition result is outputted as the musical tone signal representing the direct sound to be directly produced by the vibration of the string SP. Then, a filter 6 shown in FIG. 1 imparts resonance effect to this musical tone signal, wherein this resonance effect simulates the resonance characteristic of the acoustic board of the piano. Thereafter, a digital-to-analog converter (i.e., D/A converter, not shown) converts such digital musical tone signal into an analog musical tone signal, according to which a speaker 7 sounds the corresponding musical tone.

(2) Operation

Next, description will be given with respect to the operation of the first embodiment described above.

In an initial state where the hammer has not struck the string yet, the hammer HM is positioned apart from the string SP, so that in the musical tone forming portion 5, the relative displacement signal y−x has a negative value, therefore, the repulsion force signal F is at zero level. In addition, all of the delay circuits 554, 561, 565 are reset.

When the key-depression is made in the keyboard 1, the key information generating portion 2 outputs the keycode information KC, key-on signal KON and initial-touch information IT. In response to the keycode information KC, the string-parameter forming portion 3 outputs the delay information T1–T4, filter coefficients C1–C4 and multiplication coefficients k1–k6, which are sent to the corresponding parts in the musical tone forming portion 5. Then, the hammer-parameter forming portion 4 computes the hammer initial velocity in response to the initial-touch information IT, so that the hammer initial velocity signal Vh is outputted during the period corresponding to one cycle of the clock $\phi$. This signal Vh is supplied to the integration circuit 566 in the musical tone forming portion 5.

Figure 9:
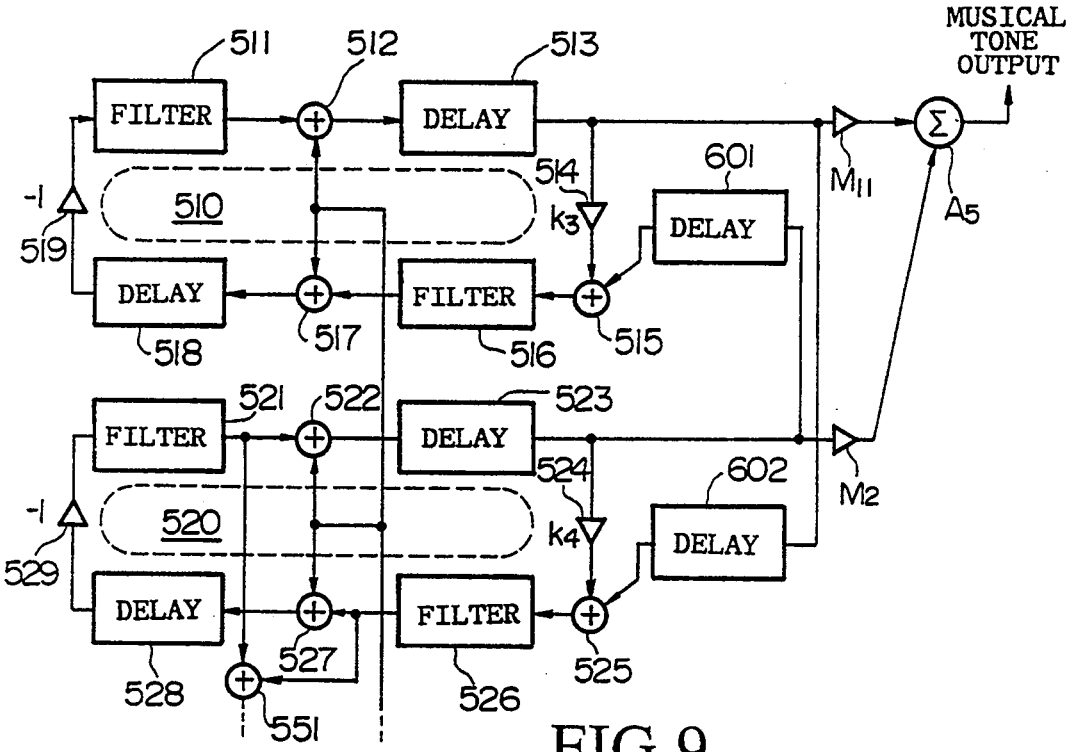

The integration result of the integration circuit 566, i.e., hammer displacement signal y varies in a direction from the negative to the positive in a lapse of time. During this period, the string displacement signal x is remained at zero level, so that the relative displacement signal $y-x$ will have a negative value (representing a state where the hammer HM is positioned apart from the string SP). Thus, as shown in FIG. 9, the repulsion force signal F is at zero level, so that the hammer velocity signal $\beta$ is also at zero level. Therefore, the hammer initial velocity signal Vh is only subject to the integration in the integration circuit 566.

Thereafter, when the value of relative displacement signal $y-x$ exceeds over the zero level (representing a state where the hammer HM collides with the string SP) and turns to the positive, the non-linear circuit 557 outputs the repulsion force signal F corresponding to the relative displacement signal $y-x$. Then, the multiplier 559 multiplies this repulsion force signal F by the coefficient "$-1/M$" to thereby compute the hammer acceleration signal $\alpha$ (having a negative value), which is integrated into the hammer velocity signal $\beta$ by the integration circuit 562. At this time, the hammer velocity signal $\beta$ is at the negative level, so that the initial velocity signal Vh is attenuated (or decelerated) by the hammer velocity signal $\beta$. Therefore, the integration circuit 566 performs the integration operation on such attenuated signal, so that increase of the hammer displacement signal y will be gradually reduced in a lapse of time. In addition, the foregoing string velocity signal $\beta$s corresponding to the repulsion force signal F is supplied to the integration circuit 555 wherein it is subject to the integration so as to vary the string displacement signal x.

During the above-mentioned operation period, the hammer displacement signal y is increased in a positive direction (representing a moving direction of the hammer HM by which the string SP is partially cut into the hammer HM), so that the relative displacement signal $y-x$ will be increased. As a result, the repulsion force signal F is increased as shown by an arrow F1 in FIG. 7.

The acceleration signal $\alpha$ is outputted in accordance with the above-mentioned repulsion force signal F, resulting that the hammer velocity signal $\beta$ is increased in a negative direction (representing a direction by which the hammer HM is moved apart from the string SP). Then, when the absolute value of the hammer velocity signal $\beta$ exceeds the value of initial velocity signal Vh so that a velocity direction of the hammer HM is turned and the hammer HM is moved apart from the string SP, the hammer displacement signal y is varied in a negative direction. Thus, the relative displacement signal $y-x$ is gradually reduced, resulting that the repulsion force signal F is also reduced (see an arrow F2). When reaching a state where "$y-x<0$" representing that the hammer HM is positioned apart from the string SP, the string striking operation of the hammer HM is completed.

As described heretofore, the repulsion force signal F is computed in the string striking operation, and this repulsion force signal F is supplied to the loop circuits 510, 520 as the excitation signal, i.e., the velocity variation component which is imparted from the hammer HM to the string SP. Then, the excitation signal will be circulated through each of the loop circuits 510, 520. In addition, the signal circulating through the loop circuit 510 is introduced into the loop circuit 520 via the multiplier M2, while the signal circulating through the loop circuit 520 is introduced into the loop circuit 510 via the multiplier M1. Thus, it is possible to simulate the mutual interference to be occurred between the strings.

The outputs of the loop circuits 510, 520 are respectively passed through the multipliers M11, M12 and then added together in the adder A5, so that the musical tone signal is formed. Then, the filter 6 imparts the resonance effect to the musical tone signal, so that the speaker 7 sounds the corresponding musical tone.

SECOND EMBODIMENT

Figure 8:
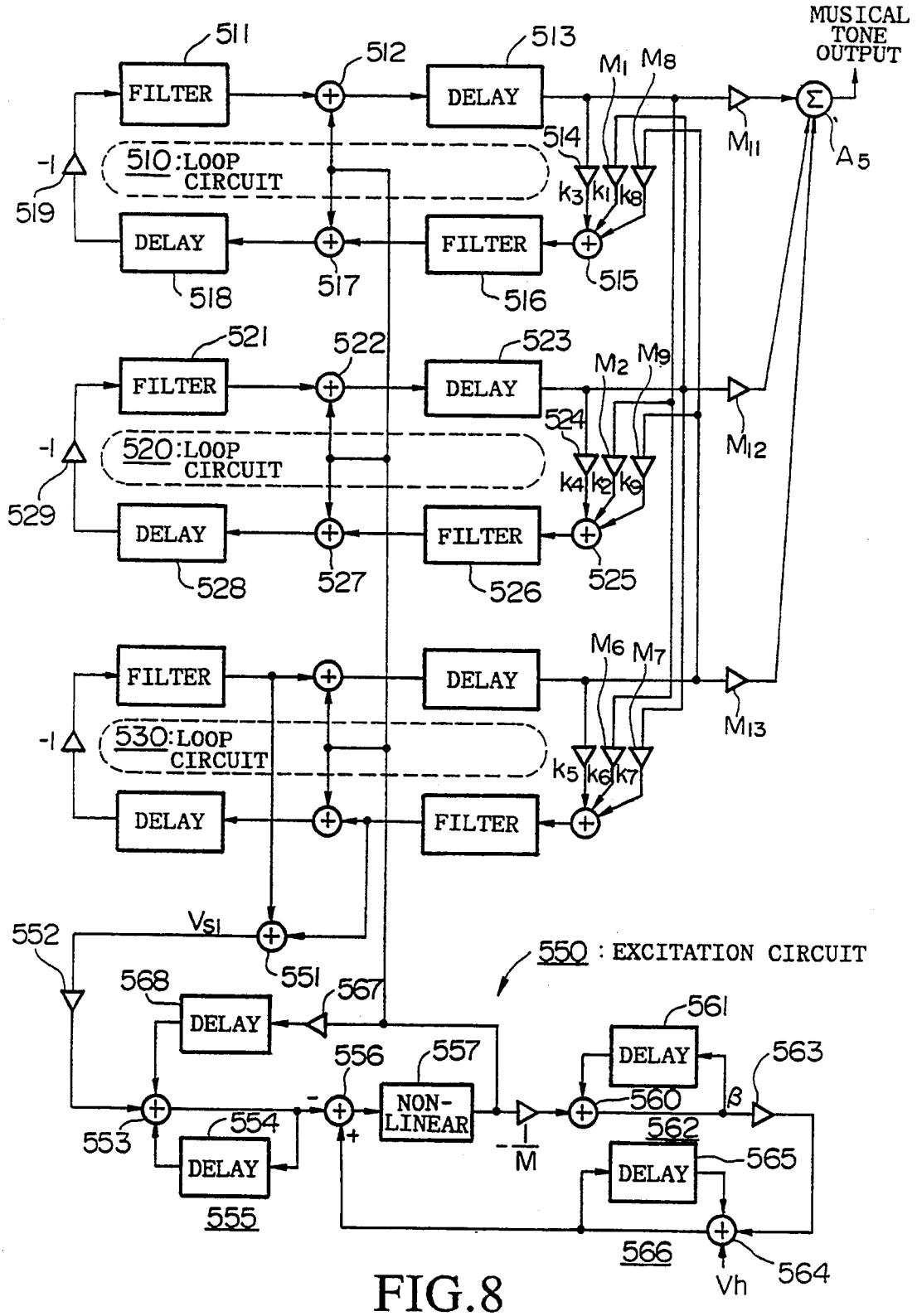
FIGS. 8 to 10 are block diagrams each showing detailed configuration of a musical tone forming portion according to another embodiment of the present invention.

FIG. 8 shows the detailed configuration of the musical tone forming portion employed in the musical tone synthesizing apparatus according to a second embodiment of the present invention. This second embodiment is designed to simulate the sound of the piano which provides three strings with respect to each key. As comparing to the first embodiment as shown in FIG. 5, the second embodiment further provides a loop circuit 530 corresponding to the third string. In order to simulate the mutual interference to be occurred among three strings, this loop circuit 530 is connected to the other loop circuits 510, 520 by means of multipliers M6 to M9 (having respective multiplication coefficients k6 to k9).

THIRD EMBODIMENT

FIG. 9 shows the detailed configuration of the musical tone forming portion employed in the musical tone synthesizing apparatus according to a third embodiment of the present invention. As comparing to the first embodiment shown in FIG. 5, the third embodiment employs delay circuits 601, 602, instead of the foregoing multipliers M1, M2, as a means which connects the loop circuits 510, 520 together. Therefore, this third embodiment can accurately simulate the propagation manner of vibration in which vibration of each string propagates from one string to another string via the fret portion with a change of the vibration phase.

FOURTH EMBODIMENT

Figure 10:
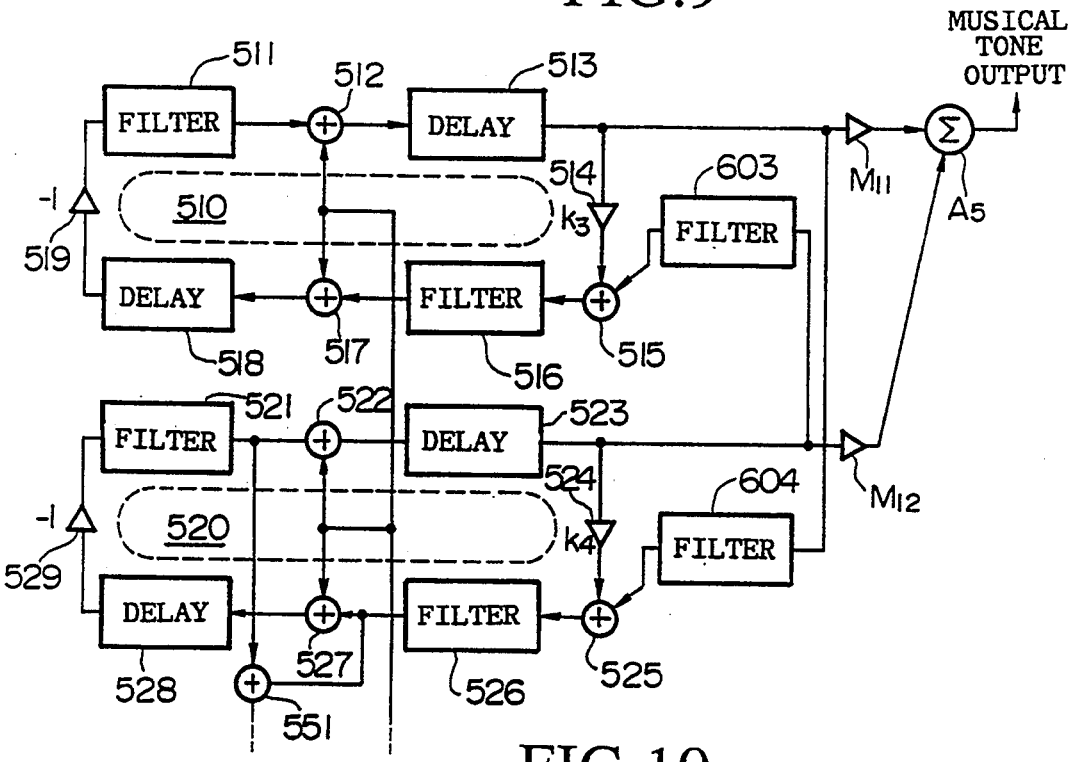

FIG. 10 shows the detailed configuration of the musical tone forming portion employed in the musical tone synthesizing apparatus according to a fourth embodiment of the present invention. As comparing to the first embodiment shown in FIG. 5, the fourth embodiment employs filters 603, 604, instead of the foregoing multipliers M1, M2, as a means which connects the loop circuits 510, 520 together, wherein these filters 603, 604 are designed to simulate the frequency characteristic corresponding to the vibration loss to be occurred at the fret portion. Therefore, this fourth embodiment can accurately simulate the propagation manner of vibration in which vibration of each string propagates through the fret portion with a change of the spectrum.

Modified Example

The above-mentioned embodiments are all designed to simulate the vibration manner of the piano in which the hammer strikes plural strings. Such configuration can be also used to simulate the resonating manner of the open string of the guitar, violin or the like. In this case, the excitation is not inputted into all loop circuits but it is inputted into one loop circuit of which delay time is set corresponding to the desirable pitch. In addition, the delay time corresponding to the pitch of the open string provided adjacent to the string which is actually plucked is set to the other loop circuits to which the excitation signal is not inputted. Thus, it is possible to form the musical tone signal corresponding to the desirable pitch in the loop circuit to which the excitation signal is inputted. Then, this musical tone signal is supplied to the other loop circuits so as to form a musical tone signal corresponding to a resonating sound to be sounded from the open string. Further, by inputting the excitation signal into only one loop circuit in the foregoing first and second embodiments, it is possible to obtain the effect of the so-called "una corda" pedal.

Incidentally, all of the embodiments described heretofore are embodied by the digital circuitry. Instead, it is possible to embody the present invention by the analog circuitry, in which effects similar to those of the digital circuitry can also be obtained. As the loop circuit containing the delay circuit, it is possible to employ the wave-guide as disclosed in Japanese Patent Laid-Open Publication No. 63-40199.

In addition, number of the loop circuits can be set corresponding to number of the strings to be provided with respect to each key. Further, it is possible to modify the first embodiment shown in FIG. 5, such that other loop circuits corresponding to all of the open strings other than the actually plucked string are further provided and these loop circuits are connected together with the foregoing loop circuits 510, 520. Thus, it is possible to simulate the unique sound effect to be applied when stepping on the damper pedal.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:

parameter generating means for generating a parameter corresponding to a musical tone to be generated;

a plurality of loop means including (a) a first loop means including at least two delay elements, and (b) at least one additional loop means including at least one delay element, each loop means for circulating a signal therein, wherein a delay time by which a signal circulates through at least a particular one of said loop means is controlled by said parameter;

connection means for connecting said plurality of loop means together such that a signal picked up from said first loop means is introduced into another of said loop means; and excitation means for inputting an excitation signal into each of said two delay elements of said first loop means, said excitation means receiving a feedback signal from at least one of the loop means to affect the value of the excitation signal, wherein a synthesized musical tone signal is picked up from at least one of a loop means and said connection means.

2. A musical tone synthesizing apparatus as defined in claim 1 for simulating the sound of a piano, wherein each loop means corresponds to a string and said excitation means corresponds to a hammer and includes means for providing an excitation signal simulating the interaction of a string with the hammer.

3. A musical tone synthesizing apparatus as defined in claim 2 wherein a number of said plurality of loop means is set corresponding to a number of strings to be provided with respect to each key of the piano.

4. A musical tone synthesizing apparatus as defined in claim 2 wherein said parameter generating means generates two kinds of parameters including a string-parameter corresponding to a resonance characteristic of said string and a hammer-parameter corresponding to a movement of said hammer, wherein the delay time of each loop means is controlled by said string-parameter.

5. A musical tone synthesizing apparatus according to claim 1, wherein the plurality of loop means are connected in parallel.

6. A music tone synthesizing apparatus comprising:

a first loop means, including at least one delay element, for receiving and circulating an input signal so that a first resonance effect is imparted to said input signal so as to synthesize a first musical tone signal;

a second loop means, including at least one delay element, for receiving and circulating said input signal so that a second resonance effect is imparted to said input signal so as to synthesize a second musical tone signal;

introducing means for filtering said first musical tone signal and introducing said filtered first musical tone signal into sid second loop means; and adding means for adding outputs of said first and second loop means together to provide a synthesizes tone signal, whereby an interference with energy exchange occurs between the first and second loop means.

7. A musical tone synthesizing apparatus as defined in claim 6 wherein said musical tone synthesizing apparatus simulates a physical phenomenon of a piano, so that said first and second loop means corresponds to two strings respectively which are provided with respect to each key of the piano.

8. A musical tone synthesizing apparatus as defined in claim 6 further comprising a control means for controlling delay times of said first and second loop means respectively.

9. A musical tone synthesizing apparatus as defined in claim 6 further comprising another introducing means for introducing said second musical tone signal into said first loop means.

10. A musical tone synthesizing apparatus as defined in claim 6 wherein said introducing means includes an amplitude controlling means for controlling an amplitude of said first musical tone signal to be introduced into said second loop means.

11. A musical tone synthesizing apparatus comprising:

parameter generating means for generating a parameter corresponding to a musical tone to be generated;

a plurality of loop means including (a) a first loop means including at least two delay elements, and at least one additional loop means including at least one delay element, each loop means for circulating a signal therein to form a tone signal, wherein a delay time by which a signal circulates through each loop means is controlled by said control parameter and set to correspond to a desired pitch of a tone signal to be formed in each loop means;

connection means for connecting said plurality of loop means together such that a signal picked up from said first loop means is introduced into another said loop means; and excitation means for inputting a common excitation signal into both of said two delay elements of said first loop means and to at least one of the additional loop means to initiate circulation of a tone signal therein;

wherein a synthesized musical tone signal is picked up from at least one of a loop means and said connection means.

12. A musical tone synthesizing apparatus as in claim 11 wherein the delay times for said loop means are controlled to correspond to the same pitch but to be slightly different in value.

13. A musical tone synthesizing apparatus as in claim 11 wherein the delay times for said loop means are controlled to correspond to different pitches approximating adjacent strings of a stringed musical instrument.

14. a musical tone synthesizing apparatus comprising:

generation means for generating an input signal;

a first loop means, including at least two delay elements, for receiving an input signal at an input side of said two delay elements and circulating said input signal so that a first resonance effect is imparted to said input signal so as to synthesize a first musical tone signal;

a second loop means including at least one delay element;

introducing means for delaying said first musical tone signal and introducing said delayed first musical tone signal into said second loop means, said second loop means circulating said delayed first musical tone signal and imparting a second resonance effect thereto so as to synthesize a second musical tone signal; and adding means for adding outputs of said first and second loop means together to provide a synthesized tone signal, whereby an interference with energy exchange occurs between the first and second loop means.

15. A musical tone synthesizing apparatus as defined in claim 14 wherein said musical tone synthesizing apparatus simulates a physical phenomenon of a piano, so that said first and second loop means corresponds to two strings respectively which are provided with respect to each key of the piano.

16. A musical tone synthesizing apparatus as defined in claim 14 further comprising a control means for controlling delay times of said first and second loop means respectively.

17. A musical tone synthesizing apparatus as defined in claim 14 further comprising another introducing means for introducing said second musical tone signal into said first loop means.

18. A musical tone synthesizing apparatus as defined in claim 14 wherein said introducing means included an amplitude controlling means for controlling an amplitude of said first musical tone signal to be introduce into said second loop means.

* * * * *